US012449235B2

(12) United States Patent
Narcy

(10) Patent No.: US 12,449,235 B2
(45) Date of Patent: Oct. 21, 2025

(54) METHOD FOR ASSISTING WITH FIRING ON A MOVING TARGET, AND ASSOCIATED DEVICE AND ASSEMBLY

(71) Applicant: THALES, Meudon (FR)

(72) Inventor: Gabriel Narcy, Saint Heand (FR)

(73) Assignee: THALES, Meudon (FR)

( * ) Notice: Subject to any disclaimer, the term of this patent is extended or adjusted under 35 U.S.C. 154(b) by 81 days.

(21) Appl. No.: 18/551,527

(22) PCT Filed: Mar. 22, 2022

(86) PCT No.: PCT/EP2022/057451
§ 371 (c)(1),
(2) Date: Sep. 20, 2023

(87) PCT Pub. No.: WO2022/200325
PCT Pub. Date: Sep. 29, 2022

(65) Prior Publication Data

US 2025/0123075 A1 Apr. 17, 2025

(30) Foreign Application Priority Data

Mar. 22, 2021 (FR) ..... 2102831

(51) Int. Cl.
*F41G 1/473* (2006.01)

(52) U.S. Cl.
CPC ..... *F41G 1/473* (2013.01)

(58) Field of Classification Search
CPC ... F41G 1/30; F41G 1/473; F41G 3/06; F41G 3/08

(Continued)

(56) References Cited

U.S. PATENT DOCUMENTS 2,464,195 A 3/1949 Burley et al.
2006/0005447 A1* 1/2006 Lenner ..... F41G 3/06 42/111

(Continued)

FOREIGN PATENT DOCUMENTS

DE 102013019281 A1 5/2015
EP 2518432 A1 10/2012

(Continued)

OTHER PUBLICATIONS

Search Report for French Application No. 21 02831 dated Jan. 28, 2022.

(Continued)

*Primary Examiner* — Bret Hayes
(74) *Attorney, Agent, or Firm* — McDonald Hopkins LLC

(57) ABSTRACT

A method for assisting with firing at a moving target, includes the steps of: displaying in a targeting window, superimposed onto the direct view of a scene, a main indicator creating a firing axis of a firing system; measuring a distance between the main indicator and a target in the scene; determining the speed of movement of the target; determining a targeting position, in the targeting window, anticipating an angular movement of the target relative to the firing axis, as a function of the speed of movement of the target, the speed of a projectile and the measured distance; and displaying, in the targeting window, a secondary indicator at the determined targeting position.

10 Claims, 10 Drawing Sheets

Figure 1:
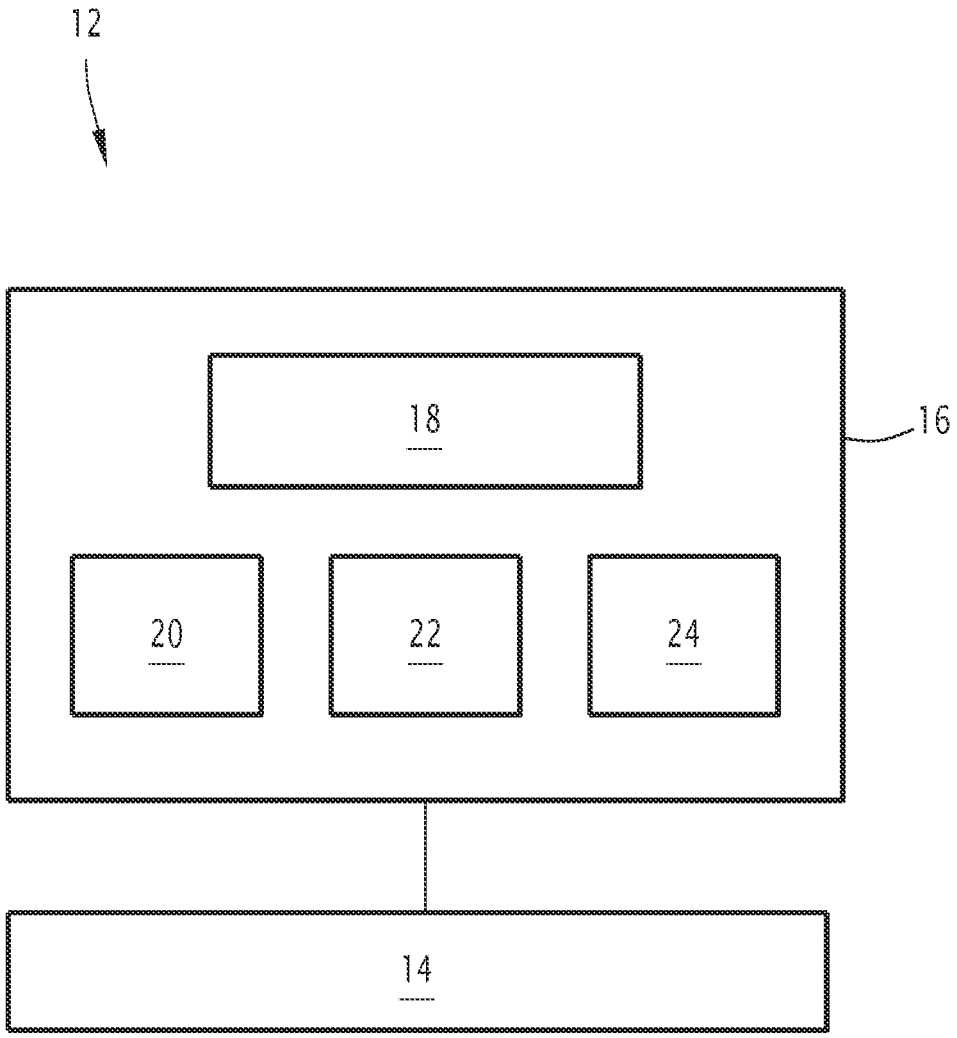

(58) Field of Classification Search
USPC ..... 42/113
See application file for complete search history.

(56) References Cited

U.S. PATENT DOCUMENTS

| | | | | |
|---|---|---|---|---|
| 2010/0201620 | A1* | 8/2010 | Sargent | F41A 33/00 345/158 |
| 2011/0297744 | A1* | 12/2011 | Schneider | F41G 1/467 235/414 |
| 2014/0026462 | A1* | 1/2014 | Linick | F41G 1/42 42/111 |
| 2016/0033233 | A1 | 2/2016 | Hakanson et al. | |
| 2020/0011641 | A1* | 1/2020 | Baker | G02B 23/02 |
| 2021/0310767 | A1* | 10/2021 | Baker | G02B 26/0816 |
| 2022/0196366 | A1* | 6/2022 | Beckman | F41G 3/12 |

FOREIGN PATENT DOCUMENTS

| | | | | |
|---|---|---|---|---|
| EP | 3260808 | B1 * | 7/2024 | F41G 3/142 |
| WO | 2005015285 | A2 | 2/2005 | |
| WO | 2013002856 | A2 | 1/2013 | |

OTHER PUBLICATIONS

Search Report for International Application No. PCT/EP2022/057451 dated Jun. 22, 2022.

* cited by examiner

18

18

18

18

18

METHOD FOR ASSISTING WITH FIRING ON A MOVING TARGET, AND ASSOCIATED DEVICE AND ASSEMBLY

CROSS-REFERENCE TO RELATED APPLICATIONS

This is a National Stage application of PCT international application PCT/EP2022/057451, filed on Mar. 22, 2022, which claims priority from French Patent Application No. 21 02831, filed on Mar. 22, 2021, both which are incorporated herein by reference in their entirety.

The present invention relates to a method of assisting with firing on a moving target. The present invention also relates to an associated firing aid device. The present invention also relates to a firing assembly comprising a firing system and such a firing aid device.

During armed field missions, precise aiming allows the infantryman to make the best use of his weapon.

To this end, targeting solutions of the clear viewfinder type are known. A clear viewfinder is an optical assembly allowing a superimposed symbol or point of light to be displayed on the direct view of a scene. The clear viewfinder type of solutions offer satisfactory accuracy while maintaining good perception of the overall situation. Indeed, these solutions enable aiming and firing with both eyes open and allow the eye to be positioned relatively far away from the clear viewfinder optics.

However, these solutions present their limitations when the target is in motion. In this case, the infantryman has to anticipate the movement of the target when aiming, which leads to inaccuracies in the shots taken.

There is therefore a need for a solution to help the infantryman aim at a moving target.

To this end, the present description has as its object a method for assisting firing at a moving target, comprising the steps of:

a. displaying, in a targeting window, a so-called main indicator, superimposed on the direct view of a scene, the main indicator creating a firing axis of a firing system,
b. measuring a distance between the main indicator and a target in the scene on which the main indicator is superimposed in the targeting window, following reception of a target designation command,
c. determining the speed of movement of the target following recognition of the target on at least two successive images of the viewing window,
d. determining an aiming position in the targeting window, anticipating an angular movement of the target relative to the firing axis, between the firing of a projectile by the firing system and the impact of the projectile, as a function of the speed of movement of the target, the speed of the projectile and the measured distance, and
e. displaying, in the targeting window, a so-called secondary indicator, at the determined targeting position.

In particular implementation modes, the method comprises one or more of the following features, taken individually or in any technically possible combination:

the method comprises a target aiming step, in which the secondary indicator is superimposed on the target in the targeting window;

the method comprises a firing step by the firing system following reception of a firing command once the secondary indicator has been superimposed on the target in the targeting window;

the determined aiming position also compensates for the ballistic rise of the firing system;

the determined aiming position also compensates for wind speed;

the aiming position determination step comprises:

a. obtaining the projectile speed from an abacus as a function of the measured distance, and
b. calculating the anticipated angular movement of the target relative to the targeting axis as a function of the determined movement speed and the obtained projectile speed, the aiming position being determined as a function of the calculated, anticipated angular movement;

the method comprises a step of displaying at least one indicator, so-called tertiary, in the targeting window, the tertiary indicator creating an aiming position to compensate only for the rise of the firing system and/or the wind speed;

each indicator is a targeting reticle.

The present description also relates to a firing aid device for a firing system, the device comprising:

a. a viewfinder able to display, in a targeting window, images superimposed on the direct view of the scene,
b. a distance measurement unit,
c. a targeting window image acquisition unit,
d. a calculator, the device being configured to implement a firing aid method as described above.

The present description also relates to a firing assembly comprising a firing system and a firing aid device as previously described.

Figure 2:
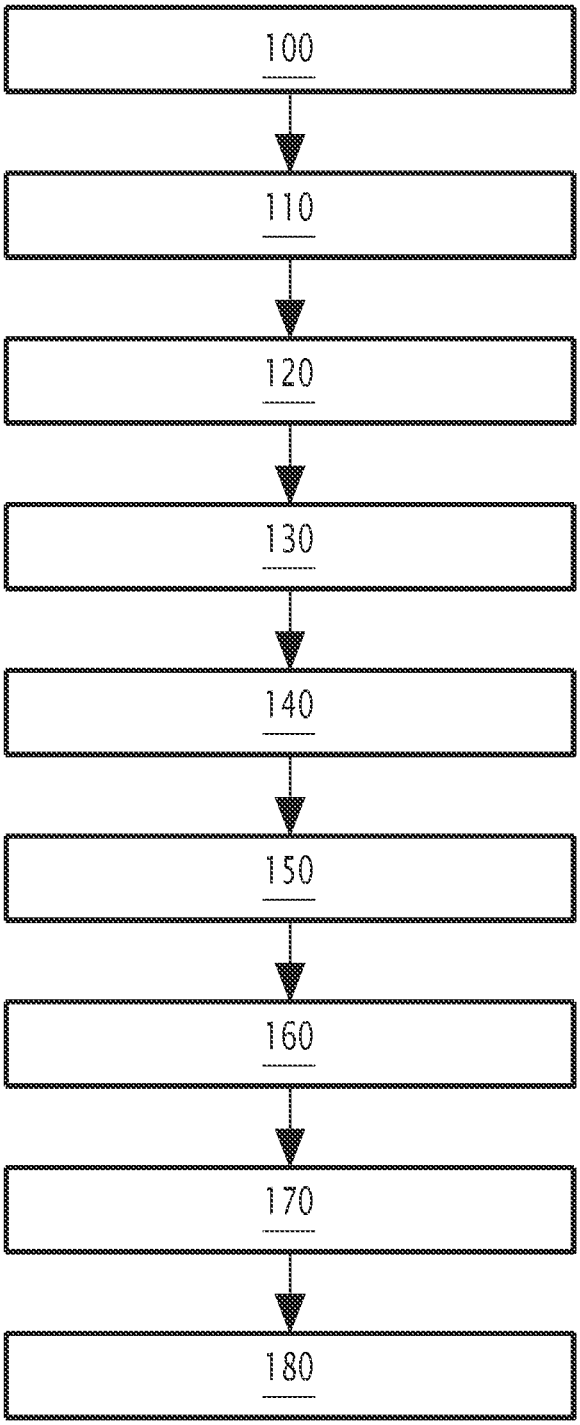
Figure 3:
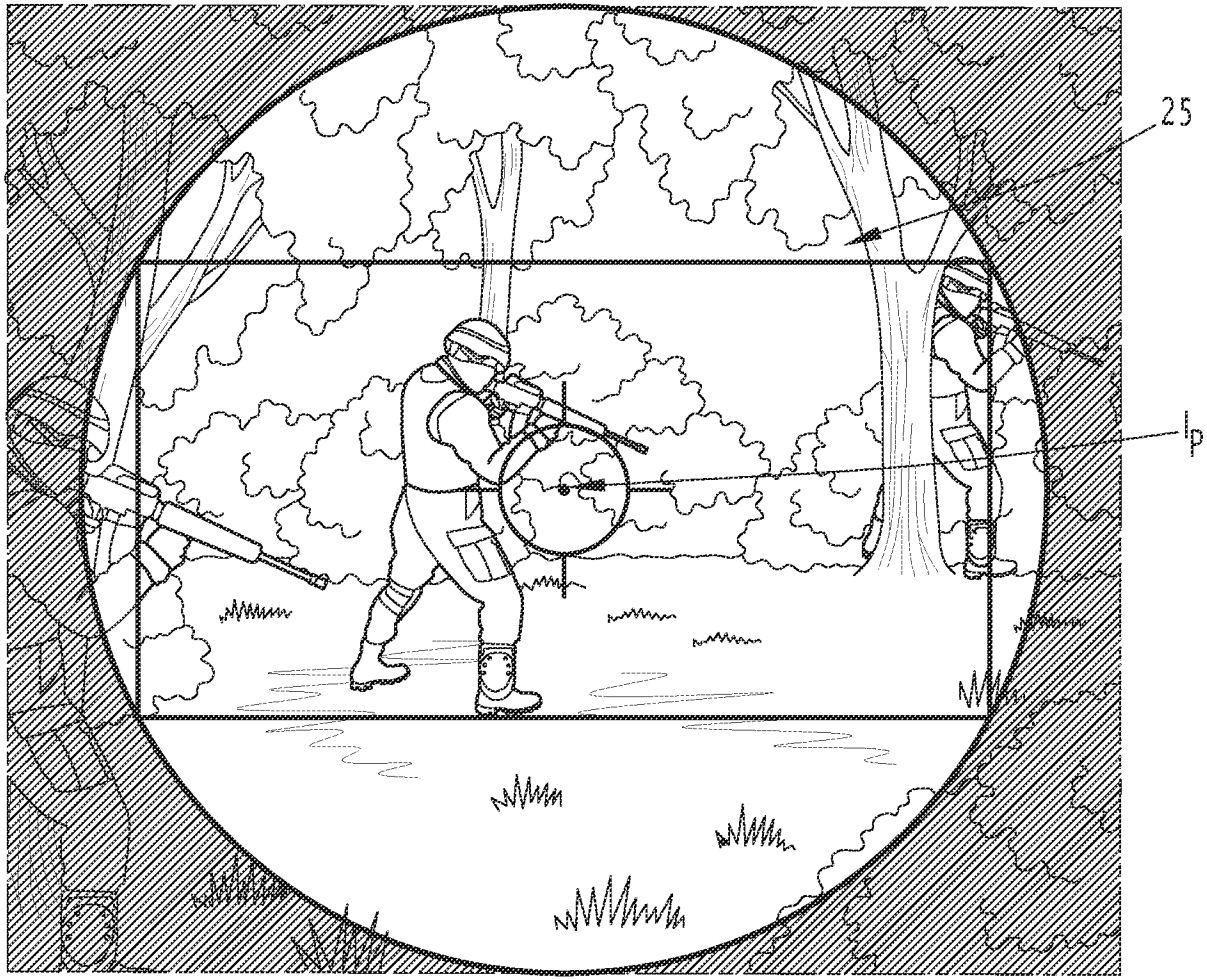
Figure 4:
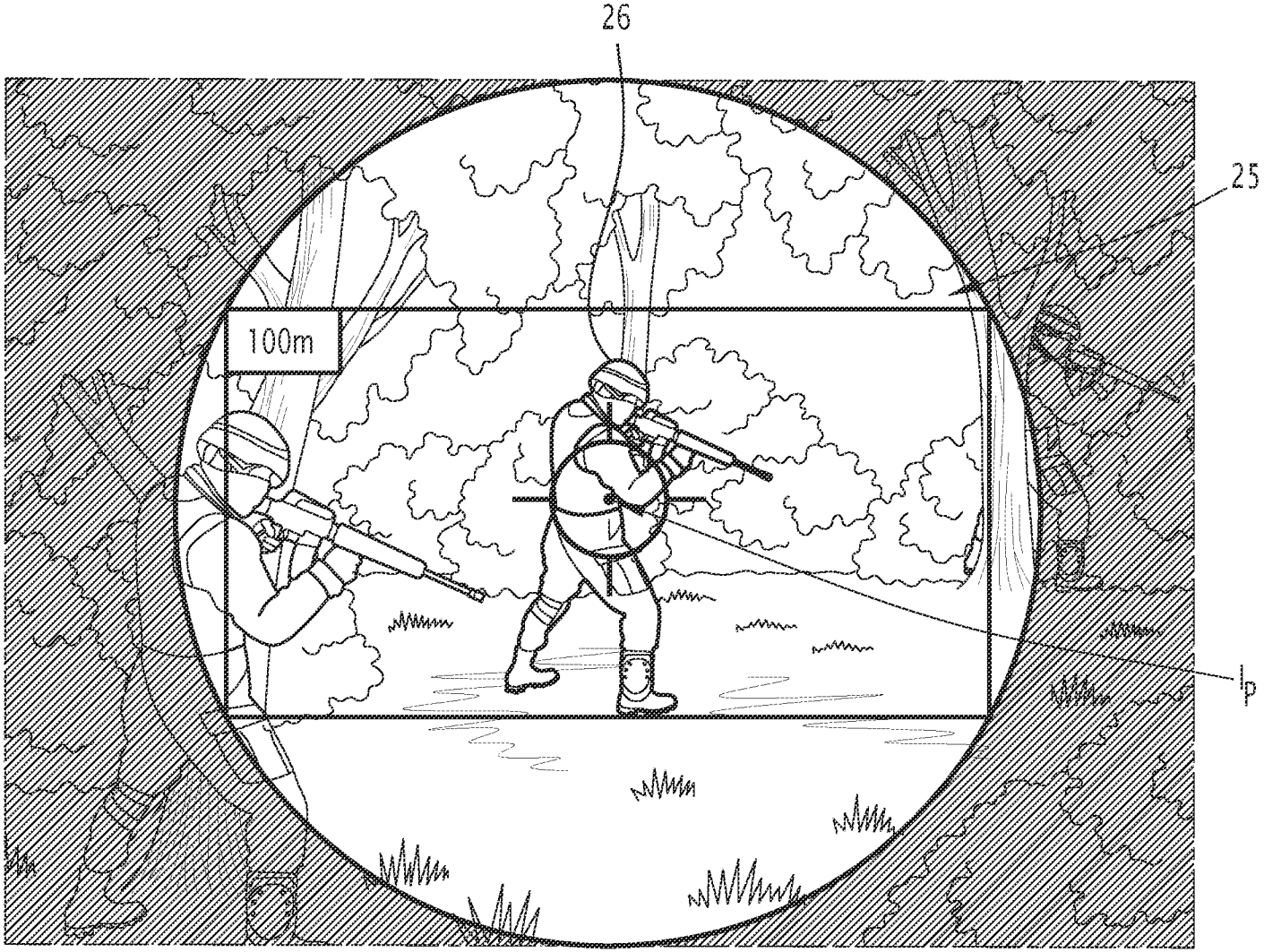
Figure 5:
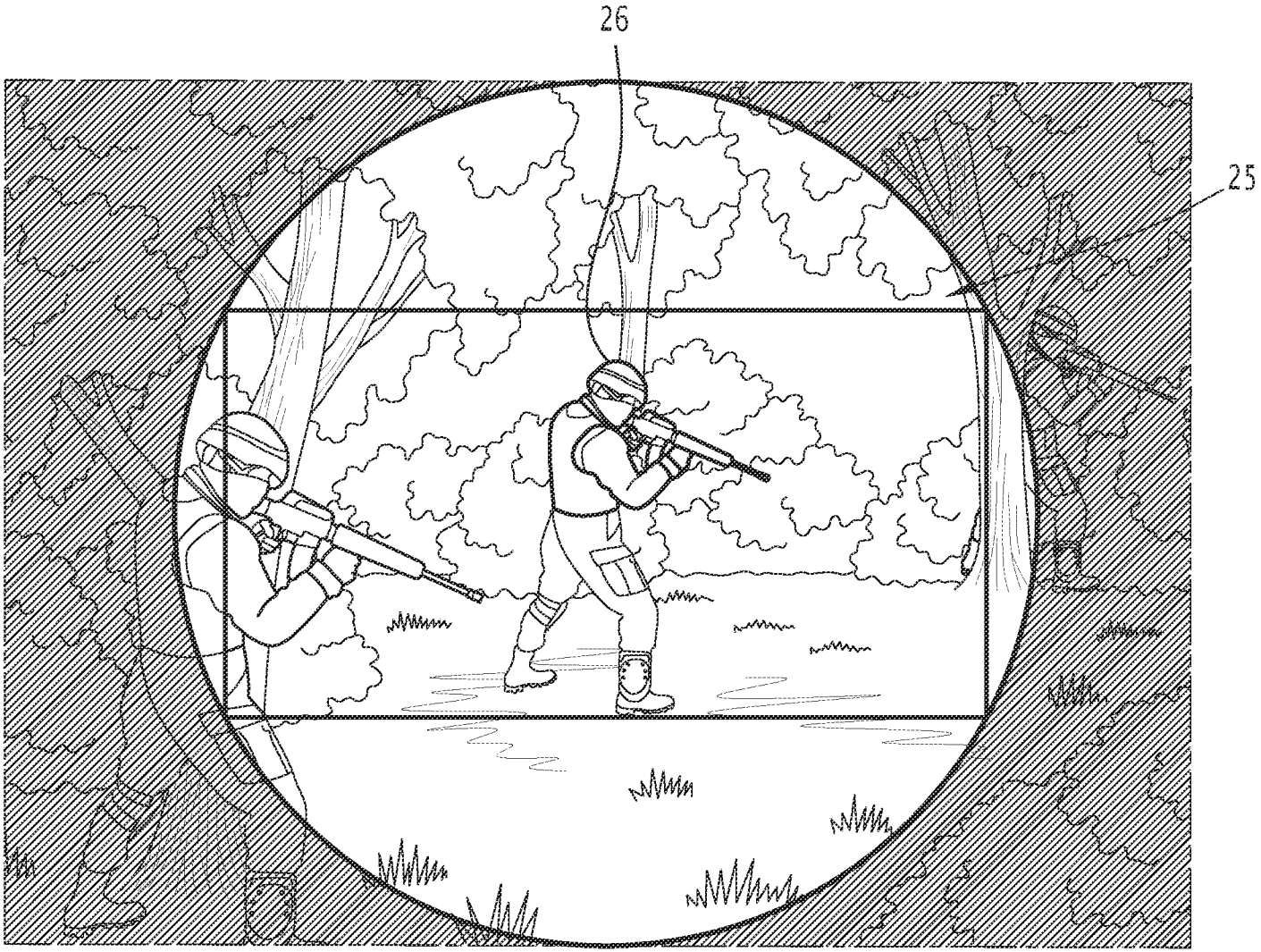
Figure 6:
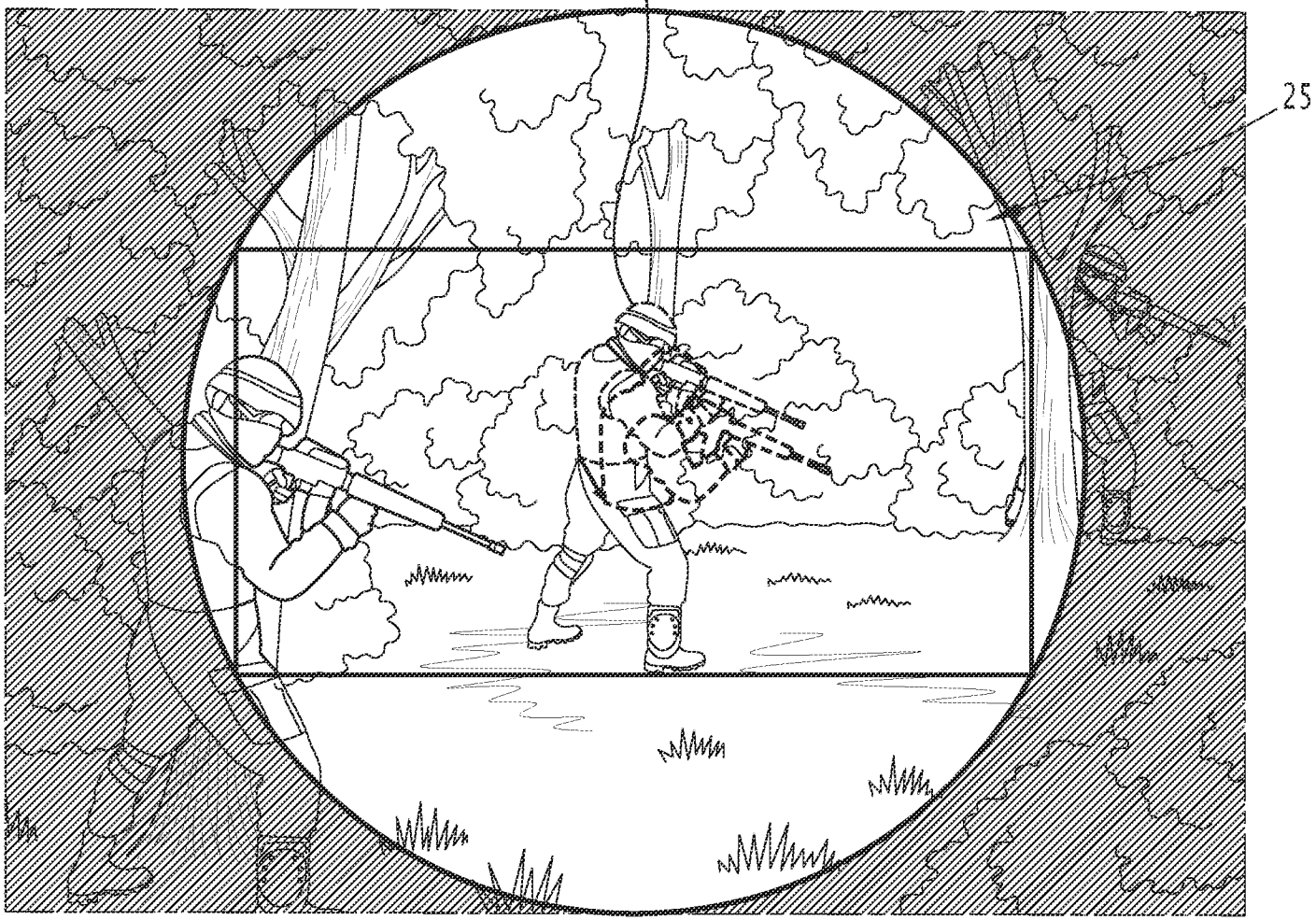
Figure 7:
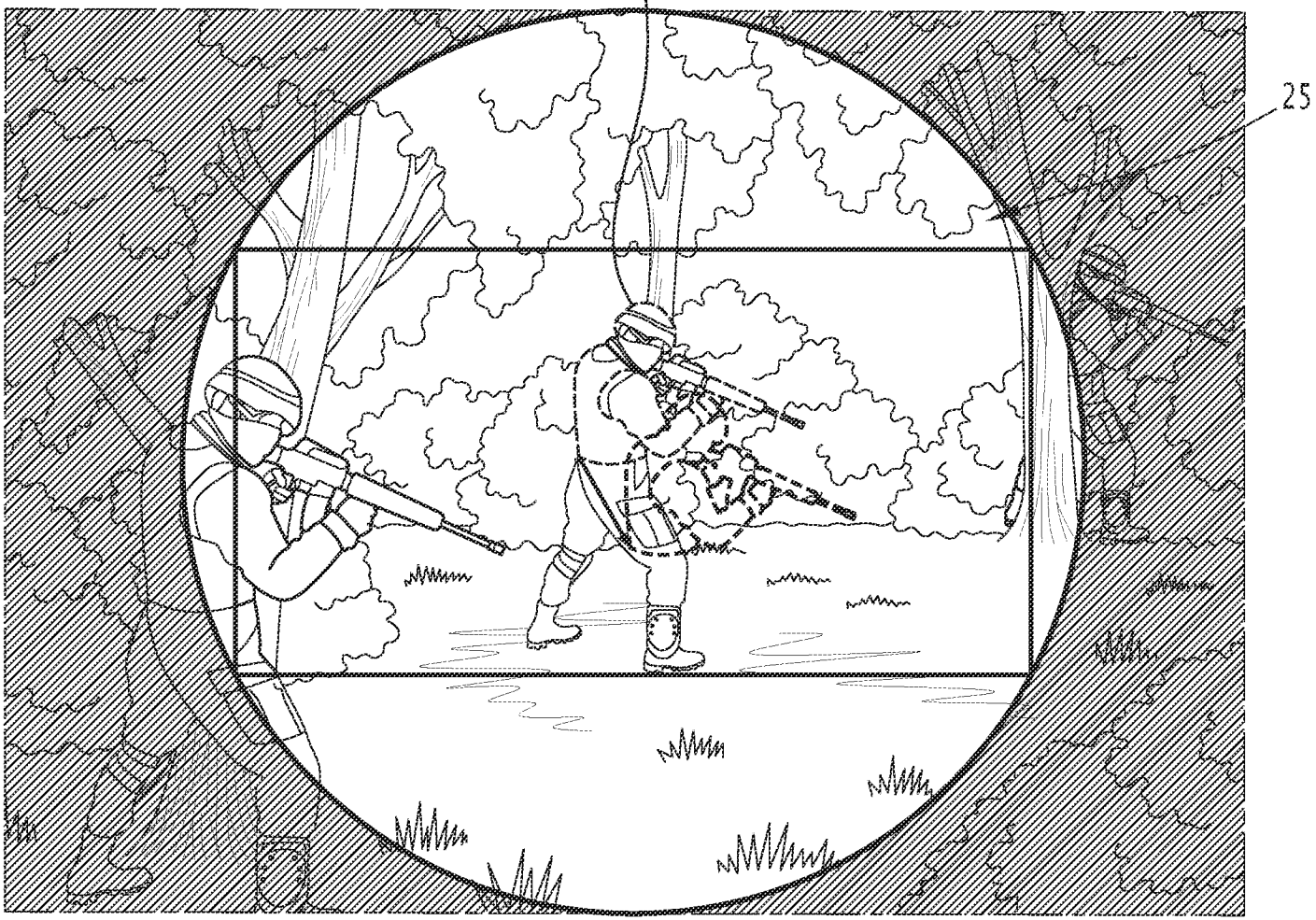
Figure 8:
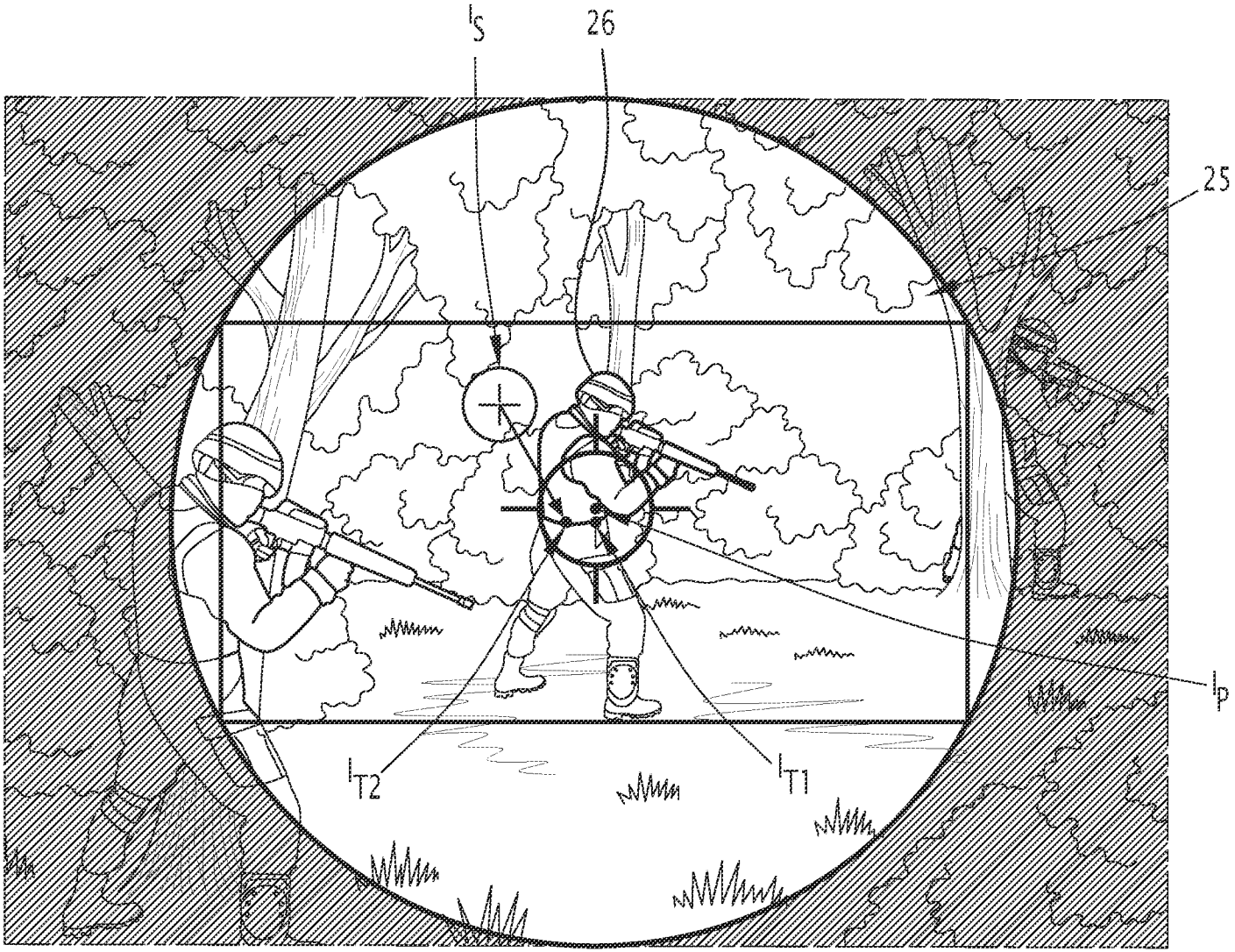
Figure 9:
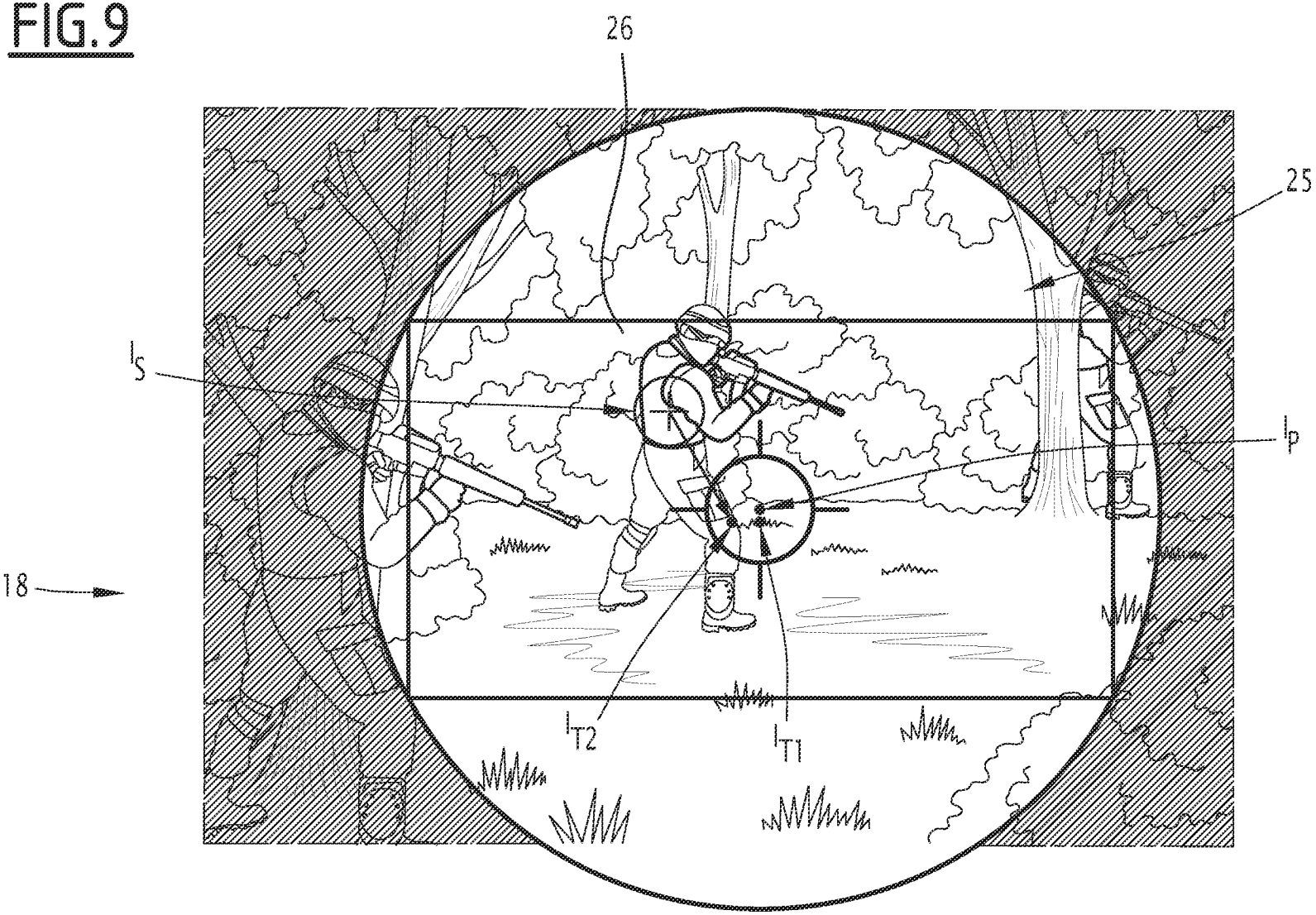
Figure 10:
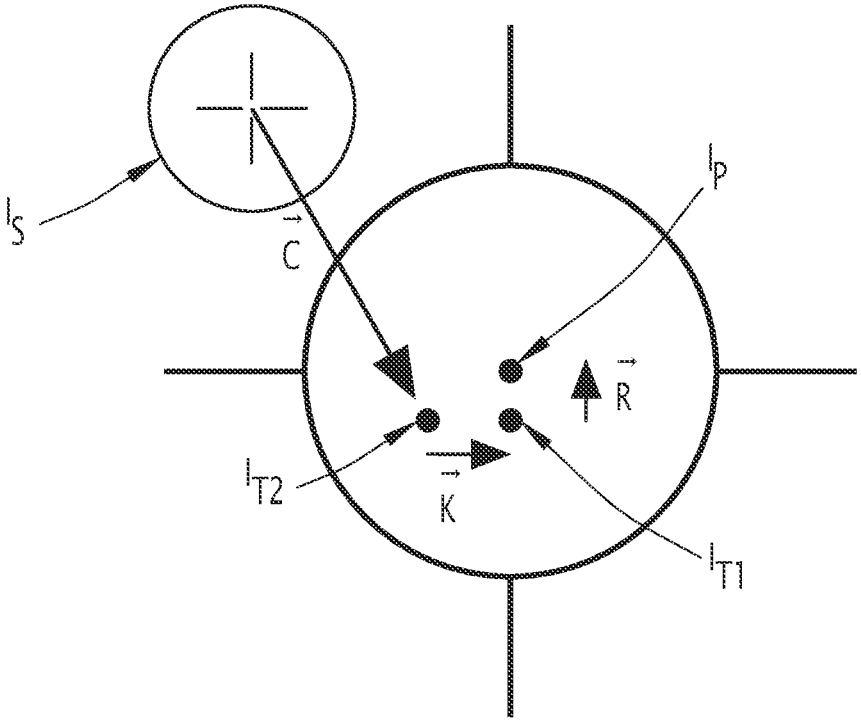

Further features and advantages of the invention will become apparent from the following description of embodiments of the invention, given by way of example only and with reference to the drawings which are:

FIG. 1 is a schematic representation of an example of a firing assembly comprising a firing system and a firing aid, FIG. 2 is a schematic representation of a method of assisting firing at a moving target, FIG. 3 is a schematic representation of an example of a targeting window through which a scene is visible in direct vision, the contours of the elements of the scene are obtained via an image acquisition unit being displayed in the targeting window superimposed on the direct vision, FIG. 4 is a schematic representation of the targeting window of FIG. 3, a main indicator being superimposed on a target of the scene in the targeting window, the contours of the target being highlighted relative to the other elements following reception of a target designation command, FIG. 5 is a schematic representation of the targeting window of FIG. 4, on which the determination of a characteristic target shape is illustrated, FIG. 6 is a schematic representation of the targeting window of FIG. 5, on which the determination of the speed of movement of the target is illustrated, FIG. 7 is a schematic representation of the targeting window of FIG. 6, on which the determination of an angular movement of the target between firing and impact of a projectile fired by the firing system is illustrated by anticipation, FIG. 8 is a schematic representation of the targeting window of FIG. 5, on which is illustrated a secondary indicator positioned, in the targeting window, to compensate for the angular movement of the target relative to the firing axis when the target is superimposed on the secondary indicator, FIG. 9 is a schematic representation of the targeting window of FIG. 8 after the firing system has been moved so as to superimpose the secondary indicator on the target, and FIG. 10 is a schematic representation of an example of the indicators displayed in the targeting window.

A firing assembly 12 is illustrated in FIG. 1. The firing assembly 12 comprises a firing system 14 and a firing aid device 16.

The firing system 14 is able to fire projectiles, such as bullets. The firing system 14 is, for example, a weapon such as a handgun or a rifle. The firing system 14 presents a firing axis, also known as the barrel axis.

The firing aid device 16 is designed to assist the aiming by a user of the firing system 14 by providing indications relative to the point of impact of a projectile fired by the firing system 14.

As illustrated in FIG. 1, the device 16 comprises a viewfinder 18, a measurement unit 20, an image acquisition unit 22 and a calculator 24.

The viewfinder 18 is able to display images in a targeting window 25, superimposed on the direct view of a scene. The viewfinder 18 is thus a clear viewfinder.

The projected images comprise at least one main indicator $I_P$ creating the firing axis of the firing system 14. As will be described later, the viewfinder 18 is also able to display other indicators.

In one example of implementation, the viewfinder 18 comprises an image projector and one or more optics able to collimate and superimpose projected images with direct vision.

The measurement unit 20 is designed to measure a distance D between the main indicator $I_P$ and a target 26 in the scene, after designation of the target 26. For this purpose, the measurement unit 20 is coordinated with the main indicator $I_P$.

The measurement unit 20 is, for example, a rangefinder (such as a laser rangefinder), or any other device allowing to determine the distance between the target 26 and the main indicator $I_P$.

The image acquisition unit 22 is able to acquire images of the targeting window 25 of the viewfinder 18, that is, images of the vision of a user looking through the targeting window 25. To this end, the image acquisition unit 22 is coordinated with the main indicator $I_P$.

Preferably, the image acquisition unit 22 is equipped with a display screen able to display images acquired from the targeting window 25 (after processing if required), superimposed on the direct view of the scene and the main indicator $I_P$.

The image acquisition unit 22 is, for example, a camera, such as a visible and/or infrared camera (for example, in the 8 μm-12 μm range).

The calculator 24 is, for example, a computer comprising a computing unit interacting with a computer program product which includes a data storage device. The calculation unit comprises a processor and at least one memory. The data storage device is, for example, a memory. The computer program product, comprising the program instructions, is stored on the data storage device.

In this example, the calculator 24 is configured to implement, in interaction with the computer program product, the steps of a firing aid method which will be described in the remainder of the description.

An example of a firing aid method using such a firing aid device 16 will now be described with reference to the flow chart in FIG. 2 and FIGS. 3 to 10.

The firing aid method comprises a step 100 of displaying (or viewing) in a targeting window 25, an indicator, known as the main $I_P$, superimposed on the direct view of a scene. By the term "display", it is understood that the main indicator $I_P$ (its image) can be viewed in the targeting window 25 by a user looking into the targeting window 25.

The scene is a place where an action takes place. The elements, such as vehicles or humans, typically move within this scene.

As previously mentioned, the main indicator $I_P$ creates the firing axis of a firing system 14. The main indicator $I_P$ is, for example, a targeting reticle. Alternatively, the main indicator $I_P$ is a dot, possibly luminous, or any other symbol.

Advantageously, the outline of elements of the scene (potential targets) obtained via the acquisition unit 22 is displayed on a display screen, superimposed on the direct view of the scene in the targeting window 25.

By way of example, FIG. 3 illustrates the targeting window 25 of the viewfinder 18, through which two moving elements (infantrymen) of a scene can be viewed in direct vision. In this example, the target window 25 is circular. A main indicator $I_P$, in the form of a targeting reticle, is also visible superimposed on the direct view. Optionally, a display screen placed in the field of view of the targeting window 25 shows the contours (or any other 25 representation or shape) of the two elements superimposed on the direct view of the scene. In this case, the contours of the two elements have typically been obtained by processing images acquired by the acquisition unit 22. The images acquired are, for example, infrared images.

The display step 100 is, for example, implemented by the viewfinder 18 of the firing 30 aid device 16.

The firing aid method comprises a step 110 of measuring a distance D between the main indicator $I_P$ and a target 26 of the scene on which the main indicator $I_P$ is superimposed in the targeting window 25, following reception of a command to designate the target 26. The target 26 is a moving element of the scene.

The superimposition of the main indicator $I_P$ on the target 26 has, for example, been achieved by a user by moving the firing system 14. The firing axis of the firing system 14 is then oriented toward the target 26.

The command to designate the target 26 has, for example, been triggered by the user via a control member once the main indicator $I_P$ has been superimposed on the target 26. The control member is, for example, a button.

The distance D is, for example, measured by the measurement unit 20 of the firing aid device 16.

By way of example, FIG. 4 shows the targeting window 25 of the viewfinder 18, through which the main indicator $I_P$ is displayed, superimposed on the target 26 (infantryman). As a result of the designation command, the contours of the target 26 on the display screen are highlighted (for example, color change) so as to differentiate the target 26 from other elements in the scene.

The firing aid method comprises a step 120 for determining the speed of movement of the target 26 following recognition of the target 26 on at least two successive images of the targeting window 25. The movement speed is a relative angular speed of the target 26 relative to the firing axis of the firing system 14 (created by the main indicator $I_P$).

By the term "successive images", it is understood that the images have been acquired at successive instants in time. For example, the images of the targeting window 25 were acquired by the acquisition unit 22 following reception of the target designation command 26. Alternatively, the acquisition unit 22 acquires images of the targeting window 25 at regular time intervals or at any instant even if no designation command is received.

Recognition of the target 26 on successive images is, for example, performed by a tracking algorithm.

By way of example, FIG. 5 illustrates the highlighting of a characteristic shape of the target 26 on the display screen, superimposed on the direct view. In this example, the characteristic shape is above the pelvis for a man in motion. FIG. 6 illustrates the determination of a velocity vector based on the movement of the characteristic shape over successive images (at least two) of the targeting window 25. It should be noted that the targeting window 25 in FIGS. 5 and 6 cannot be viewed by a user and is shown here only for purposes of understanding.

The firing aid method comprises a step 130 for determining a targeting position, in the targeting window 25, anticipating an angular movement of the target 26 relative to the firing axis, between the firing initiation and the impact of a projectile fired by the firing system 14. The targeting position is determined as a function of at least the speed of movement of the target 26, the speed of the projectile and the measured distance D.

Preferably, the determined targeting position compensates for the anticipated angular movement of the target 26 relative to the firing axis. Thus, when the target 26 is aimed at, this targeting position (superimposition of the aiming position on the target 26), the main indicator creating the firing axis is superimposed on the target 26 when the projectile impacts, the target 26 having moved.

In one alternative, the aiming position corresponds to the anticipated angular movement of the target. Then aiming is performed by superimposing the main indicator on the target 26, the aiming position being the anticipated position of the projectile impact on the target 26, which has moved.

In one implementation mode, the determination step 130 comprises obtaining the projectile speed on an abacus as a function of the measured distance D. The projectile speed obtained in this case is an average speed and depends on the firing system 14 (nature, model), the projectile and the measured distance D. The abacus has, for example, been digitized and stored in a memory in the 24 calculator.

In this embodiment, the determination step 140 also comprises calculating the anticipated angular movement of the target 26 relative to the firing axis as a function of the determined movement speed and the projectile speed obtained. The anticipated angular movement is, for example, the ratio between the determined movement speed and the projectile speed. The anticipated angular movement is, for example, expressed in minutes of arc.

The targeting position is determined as a function of the anticipated angular movement. In one example, the targeting position is the position of the main indicator $I_P$ when designating the target 26, corrected by the opposite of the anticipated angular movement, which allows to compensate for the future movement of the target 26 when aiming at the target 26 at this targeting position.

In the example in FIG. 7, the anticipated angular movement of the target 26 is illustrated. The correction consists of adapting the aim to compensate for this angular movement. It should be noted that the targeting window 25 in FIG. 7 cannot be viewed by a user and is shown here only for purposes of understanding.

Advantageously, the determined targeting position also compensates for the ballistic rise of the firing system 14. The term "ballistic rise" refers to the deviation of the trajectory of a projectile as a function of the characteristics of the firing system 14 and the projectile.

The correction relating to ballistic rise is, for example, obtained by means of an abacus as a function of the firing system 14, the projectile and the measured distance D. The abacus has, for example, been digitized and stored in a memory in the 24 calculator.

The targeting position is the position of the main indicator $I_P$ when designating the target 26, corrected by a global correction. The global correction is the sum of the correction determined for the angular movement and a correction relating to the ballistic rise.

Advantageously, the determined targeting position also compensates for wind speed. The wind is, indeed, likely to deviate the trajectory of a projectile.

In this case, a correction is determined relative to the wind speed. For example, the wind speed correction is obtained by means of an abacus as a function of the firing system 14, the projectile and the measured distance D and wind speed (measured, for example, by a sensor).

The targeting position is the position of the main indicator $I_P$ when designating the target 26, corrected by a global correction. The global correction is the sum of the angular movement correction and the wind speed correction.

Advantageously, the determined targeting position compensates for both ballistic rise and the wind speed. The targeting position is the position of the main indicator $I_P$ when designating the target 26, corrected by a global correction. The global correction is the sum of the angular movement correction, the ballistic rise correction and the wind speed correction.

The targeting aid method comprises a display step 150 of displaying, in the targeting window 25, an indicator, so-called secondary $I_S$, at the determined targeting position. The secondary indicator $I_S$ is, for example, a targeting reticle. Alternatively, the secondary indicator $I_S$ is a dot, possibly luminous, or any other symbol.

An example of a secondary indicator $I_S$ is shown in FIG. 8.

Optionally, in parallel with the display step 150, the method comprises a display step 160, for displaying at least one indicator, so-called tertiary, in the targeting window 25. The tertiary indicator $I_T$ creates a targeting position to compensate only for the rise of the firing system 14 and/or the wind speed. This thus allows to visualize the correction proposed by the firing aid device 16 in the case of a static target 26, or if the user decides not to follow the correction of the target 26 movement made by the firing aid device 16.

The tertiary indicator $I_T$ is, for example, a targeting reticle. Alternatively, the tertiary indicator $I_T$ is a dot, possibly luminous, or any other symbol.

In particular, in the example shown in FIG. 8, two tertiary indicators are displayed: a first tertiary indicator $I_T$ taking into account the ballistic rise alone, and a second tertiary indicator $I_T$ taking into account the ballistic rise and the wind speed.

FIG. 10 illustrates an example of the indicators displayed in the targeting window 25, namely:

- a primary indicator $I_P$,
- a secondary indicator $I_S$, which in this case takes into account the correction for the movement of the target 26, the correction for ballistic rise and the correction for wind speed. The secondary indicator $I_S$, is associated with a vector $\vec{C}$ indicating the angular movement correction linked to the movement of target 26, a first tertiary indicator $I_{T1}$ taking into account only the ballistic rise, the first tertiary indicator $I_{T1}$ is associated with a vector $\vec{R}$ indicating the angular movement correction related to the ballistic rise, and a second tertiary indicator $I_{T2}$ taking into account only the ballistic rise and the wind speed correction, the second tertiary indicator $I_{T2}$ is associated with a vector $\vec{K}$ indicating the angular movement correction related to the wind speed.

Optionally, the firing aid method comprises a step 170 of aiming at the target 26 by superimposing the secondary indicator $I_S$ on the target 26 in the targeting window 25. The anticipated point of impact of the projectile on the target 26 then corresponds to the primary indicator $I_P$. FIG. 9 illustrates an example of this aiming step.

Optionally, the firing aid method comprises a step 180 of firing by the firing system 14 following the reception of a firing command once the secondary indicator $I_S$ has been superimposed on the target 26 in the targeting window 25.

Thus, the method and the device described, allow the speed of the target to be taken into account in order to deduce by anticipation the position of the target at the moment of impact of the projectile. They can also provide the user with an indicator, such as a targeting reticle, to visualize in advance the position of the target when the projectile impacts. Indeed, when the secondary indicator is superimposed on the target, the main indicator corresponds to the anticipated point of impact of the projectile on the target.

This allows the user to make the right firing decision. It also improves the accuracy of firing at moving targets.

The skilled person will understand that the order of the steps of the method is given by way of example and that the steps can be implemented in a different order. The skilled person will also understand that the previously described embodiments and alternatives can be combined to form new embodiments provided that they are technically compatible.

The invention claimed is:

1. A method of assisting firing at a moving target, comprising the steps of:

a. displaying, in a targeting window, a main indicator, superimposed on a direct view of a scene, the main indicator indicating a firing axis of a firing system, b. measuring a distance between the main indicator and a target of the scene on which the main indicator is superimposed in the targeting window, following reception of a command to designate the target, c. determining a speed of movement of the target following recognition of the target on at least two successive images of the targeting window, d. determining a targeting position in the targeting window, anticipating an angular movement of the target relative to the firing axis, between the firing of a projectile by the firing system and an impact of the projectile, according to the speed of movement of the target, a speed of the projectile and the distance, and e. displaying, in the targeting window, a secondary indicator at the determined targeting position.

2. The method according to claim 1, wherein the method comprises a step of aiming at the target by superimposing the secondary indicator on the target in the targeting window.

3. The method according to claim 2, wherein the method comprises a step of firing by the firing system following reception of a firing command once the secondary indicator has been superimposed on the target in the targeting window.

4. The method according to claim 1, wherein the determined targeting position also compensates for the ballistic rise of the firing system.

5. The method according to claim 1, wherein the determined targeting position also compensates for the wind speed.

6. The method according to claim 1, wherein the step of determining the targeting position comprises:

a. obtaining the speed of the projectile from an abacus as a function of the measured distance, and b. calculating the anticipated angular movement of the target relative to the targeting axis as a function of the determined speed of movement and the obtained speed of the projectile, the targeting position being determined as a function of the calculated anticipated angular movement.

7. The method according to claim 1, in which the method comprises a step of displaying, in the targeting window, at least one tertiary indicator, the tertiary indicator creating a targeting position to compensate only for the rise of the firing system and/or the wind speed.

8. The method according to claim 1, wherein each indicator ($I_P$, $I_S$, $I_T$) is a targeting reticle.

9. A firing aid device for a firing system, the device comprising:

a. a viewfinder able to display, in a targeting window, the images superimposed on the direct view of the scene, b. a measurement unit for measuring distances, c. an acquisition unit for acquiring the images from the targeting window, d. a calculator, the device being configured to implement a method according to claim 1.

10. A firing assembly comprising a firing system and a firing aid device according to claim 9.

* * * * *